US009878874B2

(12) United States Patent
Kondo et al.

(10) Patent No.: US 9,878,874 B2
(45) Date of Patent: Jan. 30, 2018

(54) ELEVATOR-LANDING DEVICE WITH DESTINATION FLOOR ESTABLISHMENT

(75) Inventors: Takeharu Kondo, Tokyo (JP); Nobukazu Takeuchi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 492 days.

(21) Appl. No.: 14/415,321

(22) PCT Filed: Jul. 25, 2012

(86) PCT No.: PCT/JP2012/068869
§ 371 (c)(1),
(2), (4) Date: Jan. 16, 2015

(87) PCT Pub. No.: WO2014/016924
PCT Pub. Date: Jan. 30, 2014

(65) Prior Publication Data
US 2015/0183618 A1 Jul. 2, 2015

(51) Int. Cl.
*B66B 1/20* (2006.01)
*B66B 1/46* (2006.01)
*B66B 1/24* (2006.01)

(52) U.S. Cl.
CPC ..... *B66B 1/468* (2013.01); *B66B 1/2408* (2013.01); *B66B 2201/4615* (2013.01); *B66B 2201/4653* (2013.01); *B66B 2201/4676* (2013.01)

(58) Field of Classification Search
CPC ..... B66B 1/468; B66B 1/2408; B66B 2201/4615; B66B 2201/4638; B66B 2201/4653; B66B 2201/4676
(Continued)

(56) References Cited

U.S. PATENT DOCUMENTS 6,707,374 B1 * 3/2004 Zaharia ..... B66B 1/468 187/392
7,353,915 B2 * 4/2008 Zaharia ..... B66B 1/468 187/388
(Continued)

FOREIGN PATENT DOCUMENTS

CN 101959781 A 1/2011
CN 102381596 A 3/2012
(Continued)

OTHER PUBLICATIONS

Combined Chinese Office Action and Search Report dated Jun. 3, 2016 in Patent Application No. 201280074847.3 (with partial English translation of the Office Action).
(Continued)

*Primary Examiner* — Anthony Salata
(74) *Attorney, Agent, or Firm* — Oblon, McClelland, Maier & Neustadt, L.L.P.

(57) ABSTRACT

An elevator-landing device that can register a floor which is daily used as a destination floor without a button operation, and register another floor as a destination floor in accordance with necessity. The elevator-landing device includes a hall operating panel to which a user can input a destination floor, a reading part which reads identification information from an information recording medium carried by a user in the hall, by radio communication, a storage part which stores identification information associated with a destination floor, a temporary registration part which obtains the destination floor associated with the identification information and temporarily registers a call to the obtained destination floor, and a determination part which determines whether or not a predetermined destination floor establishment condition is established, when it is determined that the predeter-
(Continued)

mined destination floor establishment condition is established by the determination part.

2 Claims, 6 Drawing Sheets

(58) Field of Classification Search
USPC ..... 187/247, 380–388, 391–393, 396
See application file for complete search history.

(56) References Cited

U.S. PATENT DOCUMENTS

| | | | | |
|---|---|---|---|---|
| 7,581,622 | B2 * | 9/2009 | Amano | B66B 1/18 187/384 |
| 8,061,485 | B2 * | 11/2011 | Finschi | B66B 1/468 187/384 |
| 8,490,754 | B2 * | 7/2013 | Amano | B66B 1/468 187/384 |
| 8,813,917 | B2 * | 8/2014 | Salmikuukka | B66B 1/468 187/247 |
| 8,857,569 | B2 * | 10/2014 | Friedli | B66B 5/0012 187/384 |
| 8,910,752 | B2 * | 12/2014 | Furutani | B66B 1/468 187/384 |
| 9,174,824 | B2 * | 11/2015 | Tokura | B66B 1/468 |
| 9,238,568 | B2 * | 1/2016 | Nonami | B66B 1/468 |
| 9,284,158 | B2 * | 3/2016 | Sarjanen | B66B 1/468 |
| 9,323,232 | B2 * | 4/2016 | Blom | G05B 13/00 |
| 9,463,954 | B2 * | 10/2016 | Kumar | B66B 1/468 |
| 2009/0283369 | A1 | 11/2009 | Flynn et al. | |
| 2010/0315208 | A1 | 12/2010 | Takeuchi | |

FOREIGN PATENT DOCUMENTS

| | | | |
|---|---|---|---|
| CN | 102596775 | A | 7/2012 |
| EP | 2 500 307 | A1 | 9/2012 |
| JP | 64-2983 | A | 1/1989 |
| JP | 2000-318937 | A | 11/2000 |
| JP | 2003-226474 | A | 8/2003 |
| JP | 2005-255320 | A | 9/2005 |
| JP | 2006-096505 | A | 4/2006 |
| JP | 2006-099381 | A | 4/2006 |
| JP | 2008-050066 | A | 3/2008 |
| JP | 2009-501686 | A | 1/2009 |
| JP | 2009-249156 | A | 10/2009 |
| JP | 4690020 | B2 | 6/2011 |
| JP | 2012-56653 | A | 3/2012 |
| WO | WO 2007/011344 | A1 | 1/2007 |
| WO | WO 2007/034668 | A1 | 3/2007 |
| WO | WO 2011/058624 | A1 | 5/2011 |

OTHER PUBLICATIONS

Office Action dated Feb. 10, 2017 in Korean Patent Application No. 10-2015-7004444 (with English translation).
English translation of the International Preliminary Report on Patentability and Written Opinion dated Feb. 5, 2015 in PCT/JP2012/068869.
International Search Report dated Oct. 16, 2012 in PCT/JP2012/068869 Filed Jul. 25, 2012.
Office Action dated Feb. 2, 2016 in Japanese Patent Application No. 2014-526658 with partial English translation.
Combined Office Action and Search Report dated Oct. 9, 2015 in Chinese Patent Application No. 201280074847.3 (with English language translation and English Translation of Category of Cited Documents).
Office Action dated Aug. 9, 2016 in Korean Patent Application No. 10-2015-7004444 (with English translation).

* cited by examiner

4: HALL OPERATING PANEL
6: HALL ANTENNA
7: CAR ANTENNA
9a: INFORMATION STORAGE PART
9b: TEMPORARY REGISTRATION PART
9c: DESTINATION FLOOR REGISTRATION PART
9d: ESTABLISHMENT CONDITION DETERMINATION PART
10: CONTROL PANEL

FIG. 3

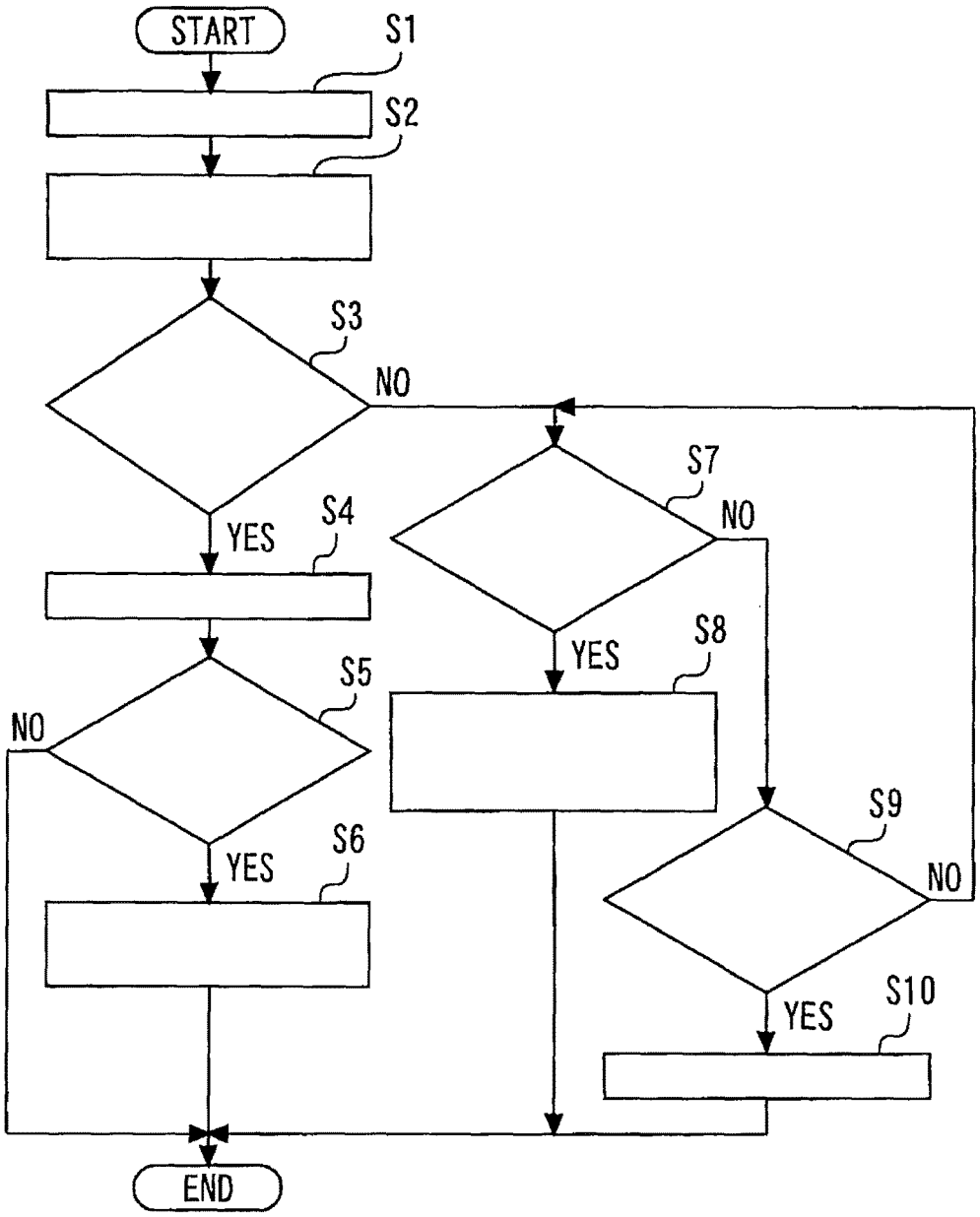

S1: DETECT TAG WITH HALL ANTENNA
S2: TEMPORARILY REGISTER DESTINATION FLOOR CALL
S3: HALL OPERATING PANEL IS OPERATED?
S4: CANCEL TEMPORARY REGISTRATION
S5: INPUTTED DESTINATION FLOOR IS AUTHORIZED FLOOR?
S6: REGISTER CALL TO INPUTTED DESTINATION FLOOR
S7: TAG IS DETECTED WITH CAR ANTENNA?
S8: ESTABLISH AND REGULARLY REGISTER DESTINATION FLOOR TEMPORARILY REGISTERED
S9: ESTABLISHMENT DETERMINATION TIME PERIOD ELAPSES?
S10: CANCEL TEMPORARY REGISTRATION

4: HALL OPERATING PANEL
6: HALL ANTENNA
9a: INFORMATION STORAGE PART
9b: TEMPORARY REGISTRATION PART
9c: DESTINATION FLOOR REGISTRATION PART
9d: ESTABLISHMENT CONDITION DETERMINATION PART
10: CONTROL PANEL

FIG. 5

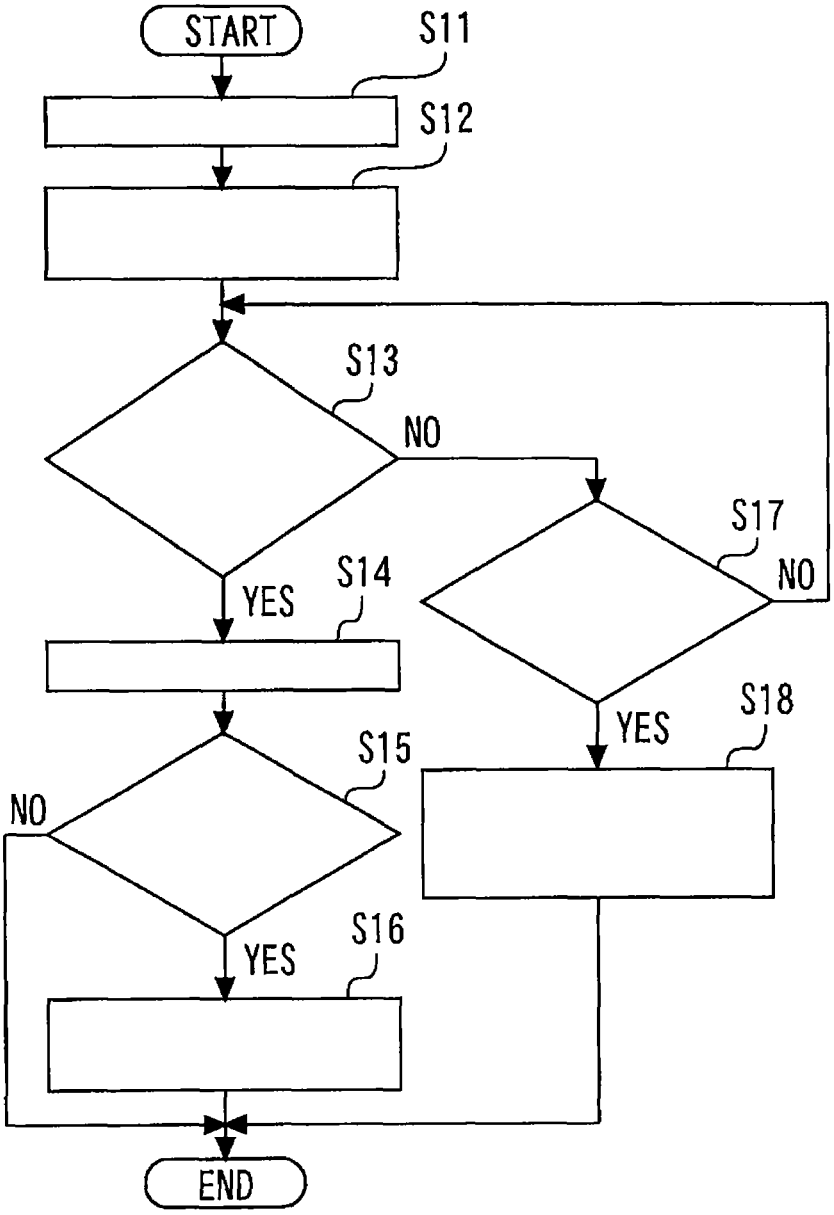

S11: DETECT TAG WITH HALL ANTENNA
S12: TEMPORARILY REGISTER DESTINATION FLOOR CALL
S13: HALL OPERATING PANEL IS OPERATED?
S14: CANCEL TEMPORARY REGISTRATION
S15: INPUTTED DESTINATION FLOOR IS AUTHORIZED FLOOR?
S16: REGISTER CALL TO INPUTTED DESTINATION FLOOR
S17: ESTABLISHMENT DETERMINATION TIME PERIOD ELAPSES?
S18: ESTABLISH AND REGULARLY REGISTER DESTINATION FLOOR TEMPORARILY REGISTERED

4: HALL OPERATING PANEL
6: HALL ANTENNA
7: CAR ANTENNA
9a: INFORMATION STORAGE PART
9b: TEMPORARY REGISTRATION PART
9c: DESTINATION FLOOR REGISTRATION PART
9d: ESTABLISHMENT CONDITION DETERMINATION PART
10: CONTROL PANEL
11: NUMBER OF PERSONS DETECTION PART

ELEVATOR-LANDING DEVICE WITH DESTINATION FLOOR ESTABLISHMENT

TECHNICAL FIELD

The present invention relates to an elevator-landing device.

BACKGROUND ART

In elevator control devices in the prior art, there is known an elevator control device including a reception part that receives a signal transmitted from an IC tag which a user of an elevator carries, a detection part that detects the recorded information in the IC tag from the signal received by the reception part, and a drive signal generation part that generates a drive signal that designates the service floor of the elevator based on the detection result of the detection part (for example, see Patent Literature 1).

Further, there has been conventionally known an elevator control device in which hall operating panels are provided at halls of the elevator, and the hall operating panels are each provided with a rise button for registering rise of a car, a descending button for registering descending of the car, and a specific destination floor button for registering a destination floor that is set for a specific hall in the elevator (for example, see Patent Literature 2).

Furthermore, there has been conventionally known an elevator control device that performs operation control to issue an operation command to designate a service floor by performing transmission and reception between a specific tag carried by an elevator user, in which private information such as destination floor designation is inputted, and a controller of the elevator, designating an elevator stop authorized floor based on the specified elevator ID and tag ID, and an elevator authentication database, and checking the authorized floor information against push button operation information (for example, see Patent Literature 3).

In addition, there has been conventionally known an elevator control device that checks a destination floor of an operation target and a destination floor that is stored in destination floor storing means when a destination button installed in a hall is operated, and a passenger who operates the destination button is identified as a passenger registered in advance by a personal identification device, registers a call to the destination floor in destination floor registration means if the destination floor of the operation target agrees with the destination floor stored in the destination floor storing means, and causes an announcement device to announce disagreement if the destination floor of the operation target disagrees with the destination floor stored in the destination floor storing means (for example, see Patent Literature 4).

Note that as an accompaniment prevention method in an entrance/exit management system, there has been conventionally known the method that authenticates a position ID and a tag ID by performing determination based on the information which is transmitted and received by an optical signal and/or a radio wave between the controller disposed at a fixed side and the tag in which various kinds of information are inputted in advance, and the information of an authentication database, compares the counted number based on the authentication determination with the counted number of persons based on image analysis by a camera, and prevents illegal invasion by accompaniment of a person who does not carry any tag based on the determination result (for example, see Patent Literature 5).

CITATION LIST

Patent Literature

Patent Literature 1: International Publication No. WO 2007-034668

Patent Literature 2: Japanese Patent Laid-Open No. 2000-318937

Patent Literature 3: Japanese Patent Laid-Open No. 2006-096505

Patent Literature 4: Japanese Patent No. 4690020

Patent Literature 5: Japanese Patent Laid-Open No. 2006-099381

SUMMARY OF INVENTION

Technical Problem

According to the control device for an elevator in the prior art shown in Patent Literature 1, the user who carries the tag can register the destination floor which is set in advance without performing a button operation or the like. However, when the user desires to set a floor other than the destination floor set in advance as a destination floor, such a case is not taken into consideration.

In contrast with this, with the elevator control devices described in Patent Literature 2 and Patent Literature 3, users can register desired destination floors by operating the service floor buttons on the hall operating panels and the service floor buttons in the cars. However, even when the same floor is daily used with a high frequency, a button operation or the like for registering the destination floor is required at each time of use, which is troublesome.

The invention is made to solve the problem as above, and obtains an elevator-landing device capable of registering a floor which is daily used with a high frequency as a destination floor without requiring a button operation or the like, and is capable of also registering a floor different from the floor which is daily used with a high frequency as a destination floor in accordance with necessity.

Means for Solving the Problems

An elevator-landing device according to the present invention includes: a hall operating panel which is provided at a hall of an elevator, and to which a user of the elevator can input a destination floor; a first reading part which reads, by radio communication, identification information recorded in an information recording medium which is carried by the user who is in the hall; a storage part which stores identification information and a destination floor in advance, the identification information being associated with the destination floor; a temporary registration part which obtains the destination floor associated with the identification information read by the first reading part, from the storage part, and temporarily registers a call to the obtained destination floor; and a determination part which determines whether or not a predetermined destination floor establishment condition is established based on at least a reading status of the identification information by the first reading part and an input status of a destination floor to the hall operating panel, wherein when it is determined that the predetermined destination floor establishment condition is established by the determination part, temporary registration by the temporary registration part is established and set as regular registration.

Advantageous Effects of Invention

In the elevator-landing device according to the invention, an effect of being capable of registering a floor which is daily used with a high frequency as a destination floor without requiring a button operation or the like, and being capable of also registering a floor different from the floor which is daily used with the high frequency as a destination floor in accordance with necessity.

BRIEF DESCRIPTION OF THE DRAWINGS

FIG. 3 is a flowchart showing an operation of the elevator-landing device related to Embodiment 1 of the present invention.

FIG. 5 is a flowchart showing an operation of the elevator-landing device related to Embodiment 2 of the present invention.

DESCRIPTION OF EMBODIMENTS

The invention will be described in accordance with the accompanying drawings. Throughout the respective drawings, the same reference signs designate the same parts or corresponding parts, and the redundant explanation thereof will be properly simplified or omitted.

Embodiment 1

Figure 1:
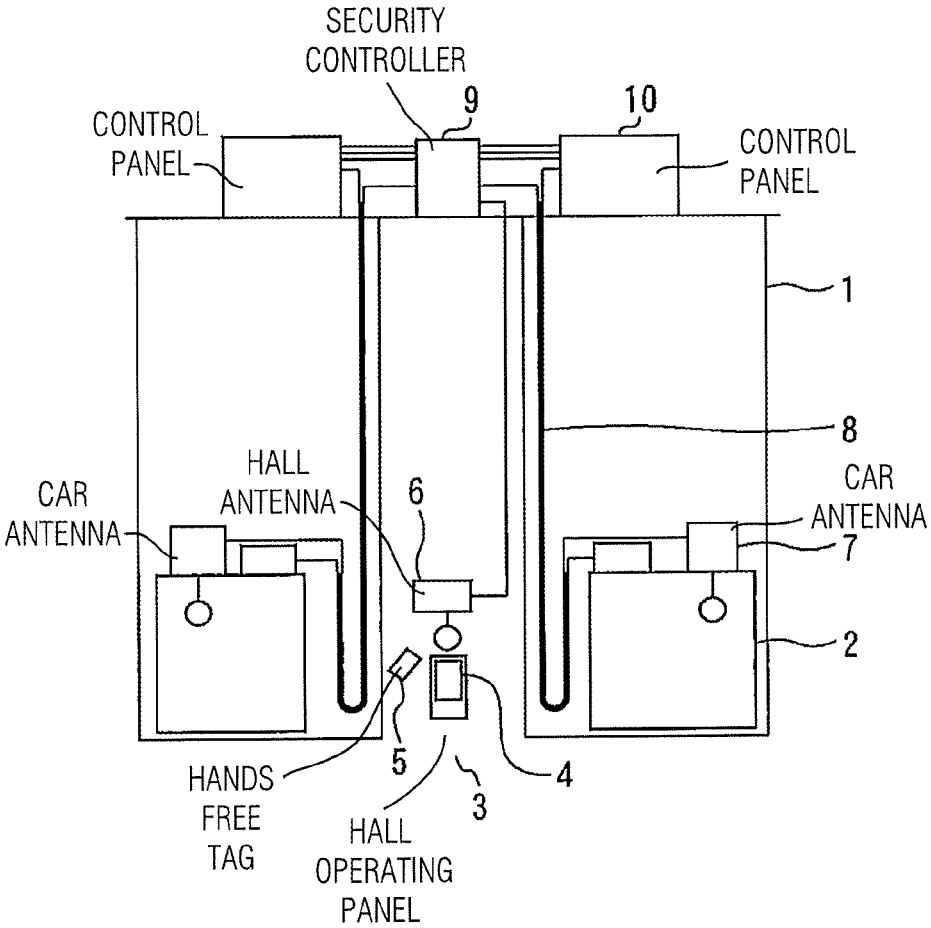
FIG. 1 is a view explaining a configuration of an elevator to which an elevator-landing device related to Embodiment 1 of the present invention is applied.
Figure 2:
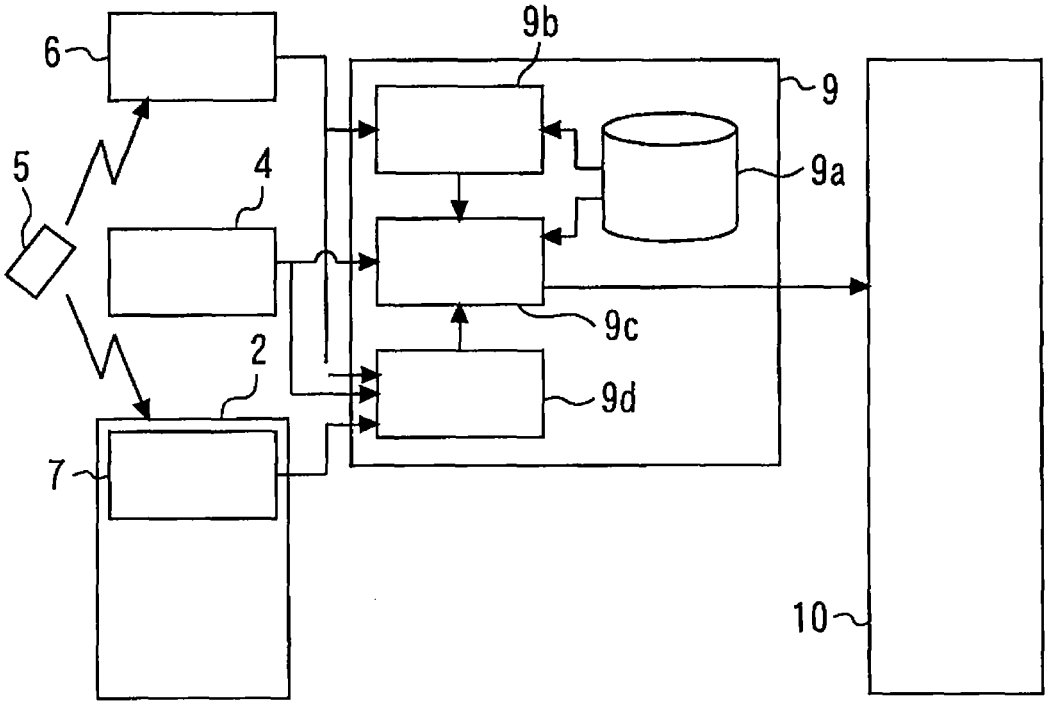
FIG. 2 is a block diagram showing a configuration of the elevator-landing device related to Embodiment 1 of the present invention.

FIG. 1 to FIG. 3 relate to embodiment 1 of the invention, FIG. 1 is a view explaining a configuration of an elevator to which an elevator-landing device is applied, FIG. 2 is a block diagram showing a configuration of the elevator-landing device, and FIG. 3 is a flowchart showing an operation of the elevator-landing device.

In FIG. 1, reference sign 1 designates a hoistway 1 that is provided substantially vertically throughout a plurality of floors in a building where the elevator is installed. In the hoistway 1, a car 2 is placed to be capable of ascending and descending. At floors where the car 2 stops, halls 3 for a user to get on and off the car 2 are provided.

In the hall 3 of each of the floors, a hall operating panel 4 is installed. The hall operating panel 4 is for the user in the hall 3 to register a desired destination floor. The hall operating panel 4 is provided with destination floor registration buttons formed of numeric keys, for example.

The user of the elevator carries a hands-free tag 5. The hands-free tag 5 is a so-called active type RFID (Radio Frequency IDentification) tag. Accordingly, the hands-free tag 5 contains a battery which supplies electric power for transmitting a radio signal from the hands-free tag 5.

In the hands-free tag 5, identification information capable of uniquely identifying each of a plurality of users is recorded in advance. In the hall 3 of the elevator, a hall antenna 6 is installed. The hall antenna 6 configures hall side reading means that reads the identification information recorded in the hands-free tag 5 by radio communication. The radio signal transmitted from the hands-free tag 5 includes the identification information recorded in the hands-free tag 5 itself. The hall antenna 6 receives the radio signal transmitted from the hands-free tag 5, and obtains the identification information recorded in the hands-free tag 5.

A communicable range (a tag detection range) by the hall antenna 6 and the hands-free tag 5 is set so that the identification information of the hands-free tag 5 which is carried by the user who advances into the hall 3 can be read. For example, when the hall 3 is relatively narrow, performance, an installation place, the number of installations and the like of the hall antenna 6 are adjusted so that a substantially entire range of the hall 3 is covered with the tag detection range by the hall antenna 6. Further, when the hall 3 is relatively large, the user can pass an inside of the tag detection range of the hall antenna 6 at least once without fail when the user advances into the hall 3 even if the entire range of the hall 3 cannot be covered with the tag detection range of the hall antenna 6. Note that the tag detection range of the hall antenna 6 is desirably covers an entrance portion of the car 2 sufficiently in relation with a tag detection range of a car antenna 7 that will be described next.

When the hands-free tag 5 carried by the user enters the tag detection range of the hall antenna 6, the hands-free tag 5 transmits the identification information recorded in the hands-free tag 5 itself to the hall antenna 6 by radio communication. The hall antenna 6 receives the identification information transmitted from the hands-free tag 5. Accordingly, the user 2 only enters the tag detection range of the hall antenna 6 in a state carrying the hands-free tag 5, whereby the identification information of the hands-free tag 5 is obtained by the hall antenna 6.

Note that the hands-free tag 5 is one example of an information recording medium which is carried by a user, has identification information recorded therein, and has the identification information read by radio communication. As the information recording medium like this, a so-called RFID tag, for example, can be used besides the hands-free tag cited here. However, from the viewpoint of a communicable distance, an active type RFID tag is desirably used. Further, by using a RFID tag of a standby communication method (a method in which a communication signal is transmitted from a tag only at a necessary time when the tag enters the tag detection range) as the hands-free tag 5, consumption of the battery which is contained in the hands-free tag 5 can be restrained.

The car antenna 7 is installed in the car 2. The car antenna 7 is for reading the identification information recorded in the hands-free tag 5 carried by the user in the car 2 by radio communication. The communicable range (the tag detection range) of the car antenna 7 and the hands-free tag 5 is set to cover substantially an entire range of the car 2.

When the hands-free tag 5 which is carried by the user enters the inside of the tag detection range of the car antenna 7, the hands-free tag 5 transmits the identification information recorded in the hands-free tag 5 itself to the car antenna 7 by radio communication. The car antenna 7 receives the identification information transmitted from the hands-free tag 5.

The identification information which is stored in the hands-free tag 5 carried by the user in the hall 3 and is read by the hall antenna 6 is sent to a security controller 9 from the hall antenna 6. Further, the identification information which is stored in the hands-free tag 5 carried by the user in the car 2, and is read by the car antenna 7 is also sent to the security controller 9 via a control cable 8 from the car antenna 7. Further, information relating to a destination floor which is inputted by an operation to the destination floor registration button on the hall operating panel 4 is also sent to the security controller 9.

The security controller 9 is to manage destination floors capable of being registered for respective kinds of identification information read by the hall antenna 6. A configuration of the elevator-landing device including a detailed configuration of the security controller 9 will be described by also referring to FIG. 2. The security controller 9 includes an information storage part 9*a*, a temporary registration part 9*b*, a destination floor registration part 9*c* and an establishment condition determination part 9*d*.

In the information storage part 9*a* included by the security controller 9, floors (authorized floors) that are authorized to be registered as the destination floors are stored in advance correspondingly to respective kinds of identification information of the users. For one kind of identification information, one or more authorized floors are set. Further, for a certain kind of identification information, one floor out of the one or more authorized floors is set as an automatically registered floor. Accordingly, the number of automatically registered floor which is set for one kind of identification information is one in principle.

The automatically registered floor is the floor which is automatically registered as the destination floor without requiring an operation on the hall operating panel 4 when the identification information is read by the hall antenna 6. The user sets the floor which the user uses the most as the automatically registered floor in advance, whereby the user can automatically register the floor as the destination floor by only carrying the hands-free tag 5 and advancing into the hall 3.

When the temporary registration part 9*b* receives input of the identification information of the hands-free tag 5 which is read by the hall antenna 6, the temporary registration part 9*b* refers to a storage content of the information storage part 9*a*, and obtains the automatically registered floor corresponding to the identification information. Subsequently, the temporary registration part 9*b* selects the automatically registered floor which is obtained, as the destination floor of temporary registration.

The information relating to the destination floor of temporary registration which is thus selected is sent to a control panel 10 from the destination floor registration part 9*c* of the security controller 9. The control panel 10 controls a general operation of the elevator including an operation of the car 2. Based on the information relating to the destination floor of temporary registration which is sent from the security controller 9, the control panel 10 registers a call to the destination floor. Subsequently, in order to respond to the registered call, the control panel 10 causes the car 2 to travel to the floor where the hall 3 which is a generation source of the call is located.

The destination floor registration part 9*c* sends the information relating to the inputted destination floor to the control panel 10 if the destination floor inputted to the hall operating panel 4 is the authorized floor of the identification information which is read by the hall antenna 6. The control panel 10 registers the call to the destination floor based on the information relating to the destination floor which is sent from the security controller 9.

The establishment condition determination part 9*d* determines whether or not a predetermined destination floor establishment condition is established, based on a reading status of the identification information of the hands-free tag 5 by the hall antenna 6 and the car antenna 7, and an input status of the destination floor to the hall operating panel 4.

In embodiment 1, the destination floor establishment condition is set to be that the same identification information is also read in the car antenna 7, before a predetermined establishment determination time period elapses without a destination floor being inputted to the hall operating panel 4, after the identification information of the hands-free tag 5 is read by the hall antenna 6.

Accordingly, the destination floor establishment condition is not established, when a destination floor is inputted to the hall operating panel 4 before the same identification information is read by the car antenna 7 after the identification information of the hands-free tag 5 is read by the hall antenna 6, and when the establishment determination time period elapses before the same identification information is also read by the car antenna 7 after the identification information of the hands-free tag 5 is read by the hall antenna 6.

When it is determined that the destination floor establishment condition is established by the establishment condition determination part 9*d*, the destination floor registration part 9*c* establishes the destination floor which is in a temporary registered state, and prevents the call to the destination floor from being cancelled carelessly after the establishment.

Meanwhile, when it is determined that the destination floor establishment condition is not established by the establishment condition determination part 9*d*, the destination floor registration part 9*c* transmits a cancel request about the call to the destination floor which is in the state of temporary registration. The control panel 10 which receives the cancel request cancels the call to the destination floor.

In the embodiment, the elevator-landing device operates in accordance with a series of flows shown in FIG. 3. First, in step S1, the hall antenna 6 detects the hands-free tag 5, and reads the identification information stored in the detected hands-free tag 5. Next, in step S2, a call to the automatically registered floor corresponding to the identification information which is read in step S1 is temporarily registered.

In subsequent step S3, the establishment condition determination part 9*d* confirms whether or not the hall operating panel 4 is operated and the destination floor is inputted. When the hall operating panel 4 is operated, and the destination floor is inputted, the flow proceeds to step S4. In step S4, the destination floor call which is temporarily registered in step S2 is cancelled because the hall operating panel 4 is operated, and thereby the destination floor establishment condition is not established.

Subsequently, the flow proceeds to step S5, and the destination floor registration part 9*c* refers to the storage content of the information storage part 9*a*, and confirms whether or not the destination floor inputted to the hall operating panel 4 is the authorized floor corresponding to the identification information which is read by the hall antenna 6. When the inputted destination floor is the authorized floor, the flow proceeds to step S6, and after the call to the inputted destination floor is registered, a series of operation flows is ended. Meanwhile, when the inputted destination floor is not the authorized floor, step S6 is omitted, and a series of operation flows is ended without the call being registered.

Meanwhile, when the hall operating panel 4 is not operated in step S3, the flow proceeds to step S7. In step S7, the establishment condition determination part 9*d* confirms whether or not the car antenna 7 detects the hands-free tag 5 having the same identification information as in step S1. When the car antenna 7 detects the hands-free tag 5 having the same identification information as the identification information detected in step S1, the establishment condition determination part 9*d* determines that the destination floor establishment condition is established, and the flow proceeds to step S8.

Since in step S8, it is determined that the destination floor establishment condition is established, the destination floor call which is temporarily registered in step S2 is established as regular registration, and a series of operation flows is ended.

Meanwhile, when in step S7, the car antenna 7 does not detect the hands-free tag 5 having the same identification information as the identification information detected in step S1, the flow proceeds to step S9. In step S9, the establishment condition determination part 9*d* confirms whether or not the predetermined establishment determination time period elapses after the hall antenna 6 detects the hands-free tag 5 in step S1. When the predetermined establishment determination time period elapses after the hall antenna 6 detects the hands-free tag 5, the flow proceeds to step S10.

In step S10, the destination floor establishment condition is not established because the establishment determination time period elapses before the car antenna 7 detects the hands-free tag 5, the destination floor call which is temporarily registered in step S2 is cancelled. Subsequently, a series of operation flows is ended. Meanwhile, when the predetermined establishment determination time period does not elapse after the hall antenna 6 detects the hands-free tag 5 in step S9, the flow returns to step S3.

Note that the elevator assumed here performs group control that performs operation control with a plurality of cars 2 set as one group, and includes a so-called destination prediction system that informs a user of Elevator No. or the like of the car 2 which is assigned to the destination floor registered by the user. Therefore, the car 2 which the user will get on after the destination floor is automatically registered by the hands-free tag 5 which is carried by the user is the car 2 which is assigned to the destination floor.

Accordingly, in the case of the elevator which includes the destination prediction system as above, when establishment of the destination floor establishment condition is determined, only the tag detection result of the car antenna of the car 2 which is assigned to the destination floor automatically registered by the hands-free tag 5 may be confirmed instead of confirming the tag detection results by all the car antennas 7.

Note that the elevator-landing device described above stores the identification information and the automatically registered floor of the user into the information storage part 9*a* of the security controller 9. In this regard, the automatically registered floor is stored in the hands-free tag 5 carried by the user in advance, and the automatically registered floor can be read and used with the identification information of the hands-free tag 5 by the hall antenna 6.

The elevator-landing device which is configured as above includes the hall operating panel which is provided at the hall of the elevator, and to which the user of the elevator can input the destination floor, the hall antenna that is a first reading part which reads the identification information recorded in an information recording medium which is carried by the user who is in the hall, by radio communication, the storage part which associates the identification information with a destination floor and stores the identification information and the destination floor in advance, the temporary registration part which obtains the destination floor associated with the identification information read by the first reading part from the storage part, and temporarily registers a call to the obtained destination floor, and the determination part which determines whether or not a predetermined destination floor establishment condition is established based on at least a reading status of the identification information by the first reading part and an input status of a destination floor to the hall operating panel, wherein when it is determined that the predetermined destination floor establishment condition is established by the determination part, temporary registration by the temporary registration part is established and set as regular registration.

Furthermore, the elevator-landing device includes the car antenna that is a second reading part which reads the identification information recorded in the information recording medium which is carried by a user who is in the car of the elevator, by radio communication, wherein the predetermined destination floor establishment condition is set to be that the same identification information as the identification information which is read by the first reading part is read by the second reading part, before a predetermined establishment determination time elapses without a destination floor being inputted to the hall operating panel, after the identification information is read by the first reading part.

Therefore, the floor which is daily used with a high frequency can be registered as the destination floor without requiring a button operation or the like, while a floor different from the floor which is daily used with a high frequency can be registered as the destination floor in accordance with necessity, and great convenience is provided to the user.

Further, since when the destination floor is inputted from the hall operating panel, the destination floor is registered only when the inputted destination floor is the authorized floor, the floor to which the user is not authorized to go is prevented from being registered as the destination floor, and convenience can be improved while security is ensured.

Furthermore, at the time point when the user carrying the hands-free tag advances into the hall, the call to the destination floor which is the floor having a high probability of the user selecting the floor as the destination floor can be temporarily registered, and therefore, realization of high operation efficiency especially in the group control elevator can be expected.

Embodiment 2

Figure 4:
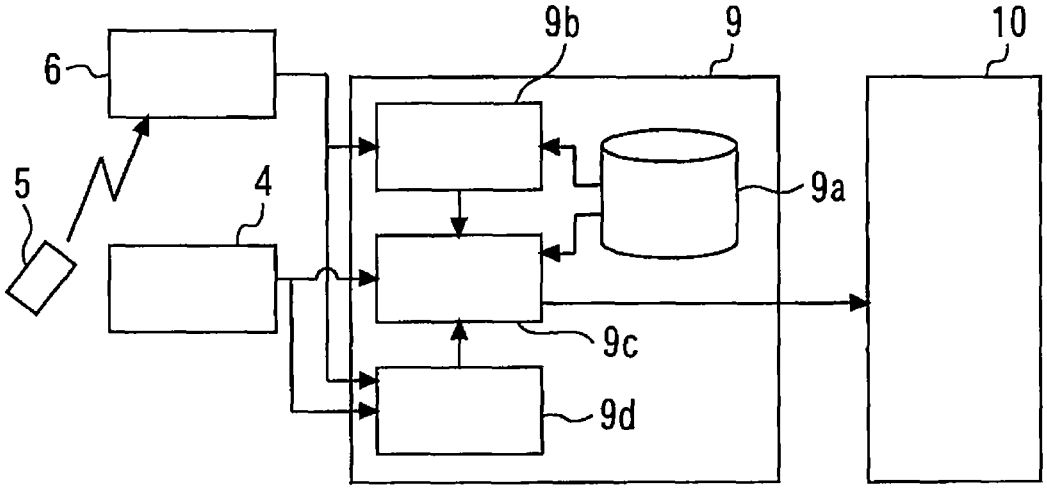
FIG. 4 is a block diagram showing a configuration of an elevator-landing device related to Embodiment 2 of the present invention.

FIG. 4 and FIG. 5 relate to embodiment 2 of the invention, FIG. 4 is a block diagram showing a configuration of an elevator-landing device, and FIG. 5 is a flowchart showing an operation of the elevator-landing device.

Embodiment 2 described here sets the destination floor establishment condition to be that a predetermined establishment determination time period elapses without the destination floor being inputted to the hall operating panel after the identification information of the hands-free tag is read by the hall antenna, in the configuration of embodiment 1 described above. Accordingly, when the destination floor is inputted to the hall operating panel before the predetermined establishment determination time period elapses after the identification information of the hands-free tag is read by the hall antenna, the destination establishment condition is not established.

FIG. 4 shows the configuration of the elevator-landing device in this embodiment. In this embodiment, the destination floor establishment condition does not include the tag detection result in the car antenna. Therefore, the car antenna may be eliminated as shown in FIG. 4. Subsequently, the establishment condition determination part 9*d* included by the security controller 9 determines whether or not the predetermined destination floor establishment condition is established based on the reading status of the identification information of the hands-free tag 5 by the hall antenna 6, and the input status of the destination floor to the hall operating panel 4.

Note that the other components are similar to those in embodiment 1, and the detailed explanation thereof will be omitted.

In this embodiment, the elevator-landing device operates in accordance with a series of flows shown in FIG. 5. First, in step S11, the hall antenna 6 detects the hands-free tag 5, and reads the identification information which is stored in the detected hands-free tag 5. Next, the flow proceeds to step S12, and the call to the automatically registered floor corresponding to the identification information which is read in step S11 is temporarily registered.

In subsequent step S13, the establishment condition determination part 9*d* confirms whether or not the hall operating panel 4 is operated and the destination floor is inputted. When the hall operating panel 4 is operated and the destination floor is inputted, the flow proceeds to step S14. In step S14, the destination floor establishment condition is not established because the hall operating panel 4 is operated, and therefore, the destination floor call which is temporarily registered in step S12 is cancelled.

Subsequently, the flow proceeds to step S15, and the destination floor registration part 9*c* refers to the storage content of the information storage part 9*a*, and confirms whether or not the destination floor inputted to the hall operating panel 4 is the authorized floor corresponding to the identification information which is read by the hall antenna 6 in step S11. When the inputted destination floor is the authorized floor, the flow proceeds to step S16, and after the call to the inputted destination floor is registered, a series of operation flows is ended. Meanwhile, when the inputted destination floor is not the authorized floor, step S16 is omitted, and a series of operation flows is ended without the call being registered.

When the hall operating panel 4 is not operated in step S13, the flow proceeds to step S17. In step S17, the establishment condition determination part 9*d* confirms whether or not the predetermined establishment determination time elapses after the hall antenna 6 detects the hands-free tag 5 in step S11. When the predetermined establishment determination time period elapses after the hall antenna 6 detects the hands-free tag 5, the establishment condition determination part 9*d* determines that the destination floor establishment condition is established, and the flow proceeds to step S18.

Since in step S18, it is determined that the destination floor establishment condition is established, the destination floor call which is temporarily registered in step S12 is established and set as regular registration, and a series of operation flows is ended. Meanwhile, when in step S19, the predetermined establishment determination time period does not elapse after the hall antenna 6 detects the hands-free tag 5, the flow returns to step S13.

The elevator-landing device which is configured as above is such that in the configuration of embodiment 1, the predetermined destination floor establishment condition is set to be that a predetermined establishment determination time period elapses without a destination floor being inputted to the hall operating panel, after the identification information is read by the hall antenna which is the first reading part.

Therefore, the floor which is daily used with a high frequency can be registered as the destination floor without requiring a button operation or the like, with the simpler configuration, without the antenna which detects the hands-free tag being provided in the car, and a floor that is different from the floor which is daily used with the high frequency also can be registered as a destination floor in accordance with necessity.

Embodiment 3

Figure 6:
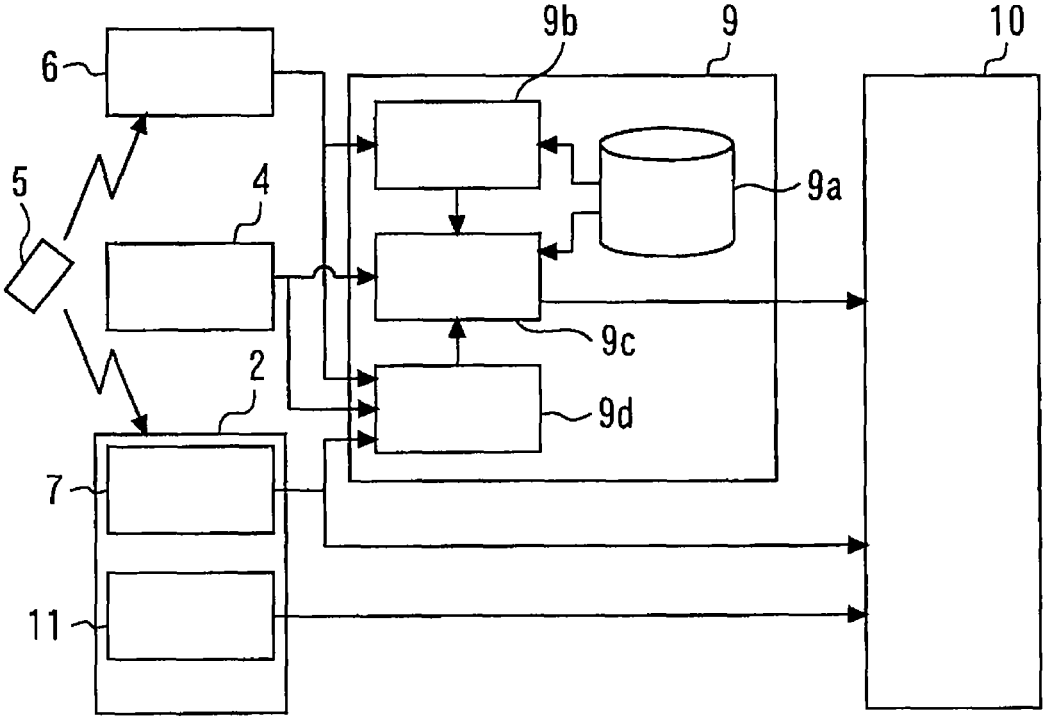
FIG. 6 is a block diagram showing a configuration of an elevator-landing device related to Embodiment 3 of the present invention.

FIG. 6 relates to embodiment 3 of the invention, and is a block diagram showing a configuration of an elevator-landing device.

Embodiment 3 described here is provided with means for detecting a number of users who get into the car, and does not allow the car to start when disagreement occurs to the number of detected tags by the car antenna and the number of detected users who get into the car, in the configurations of embodiment 1 and embodiment 2 described above.

Here, a case based on the configuration of embodiment 1 will be described. As shown in FIG. 6, the car 2 is provided with a number of persons detection part 11 that detects a number of users who are in the car 2. More specifically, the number of persons detection part 11 can be configured by using a weighing device that detects a weight which is applied to the car 2, and calculating the number of persons in the car 2 based on a detection value of the weighing device, for example.

Alternatively, as another example, the number of persons detection part 11 can be configured by using a camera device that photographs a situation in the car 2, and calculating the number of persons in the car 2 by performing image analysis with respect to an image photographed by the camera device. As still another example, the number of persons detection part 11 also can be configured by detecting the number of persons in the car 2 by a human sensor using an infrared sensor or the like.

The number of detected persons by the number of persons detection part 11 is sent to the control panel 10 which controls the car 2 provided with the number of persons detection part 11. Further, the number of hands-free tags 5 detected by the car antenna 7 in the car 2 (this can translate into the number of kinds of discrimination information which are read by the car antenna 7) is also sent to the control panel 10 which controls the car 2.

The control panel 10 compares the number of users detected by the number of persons detection part 11 and the number of hands-free tags 5 detected by the car antenna 7. When these numbers correspond to each other, the control panel 10 allows departure of the car 2. Meanwhile, when these numbers do not correspond to each other, the control panel 10 does not allow departure of the car 2, and inhibits the departure of the car 2.

Accordingly, when a person who does not carry the hands-free tag 5 gets into the car 2, the number of users detected by the number of persons detection part 11 and the number of hands-free tags 5 detected by the car antenna 7 do not correspond to each other, and therefore, departure of the car 2 is inhibited. Therefore, the person who does not carry the hands-free tag 5 is prevented from illegally getting on the car 2 and moving to another floor, and security can be improved.

The other components and operations are similar to those in embodiment 1, and the detailed explanation thereof will be omitted.

Note that the configuration characteristic of embodiment 3 described above can be mounted to the configuration of embodiment 2 described above as a matter of course. However, as described above, embodiment 2 can be configured without being provided with the car antenna 7. In contrast with this, in embodiment 3 described here, the car antenna 7 is a necessary configuration. Accordingly, when the configuration characteristic of embodiment 3 described above is mounted to the configuration of embodiment 2, not only the number of persons detection part 11 but also the car antenna 7 is needed to be provided in the configuration of embodiment 2.

INDUSTRIAL APPLICABILITY

The invention is applicable to an elevator-landing device which reads identification information recorded in an information recording medium that is carried by a user who is in an elevator hall by radio communication, and automatically registers a destination floor based on the identification information which is read.

DESCRIPTION OF SYMBOLS

1 hoistway
2 car
3 halls
4 hall operating panel
5 hands-free tag
6 hall antenna
7 car antenna
8 control cable
9 security controller
9*a* information storage part
9*b* temporary registration part
9*c* destination floor registration part
9*d* establishment condition determination part
10 control panel
11 number of persons detection part

The invention claimed is:

1. An elevator-landing device, comprising:

a hall operating panel which is provided at a hall of an elevator, and to which a user of the elevator can input a destination floor;

a first reading part which reads, by radio communication, identification information recorded in an information recording medium which is carried by the user who is in the hall;

a second reading part which reads, by radio communication, identification information recorded in an information recording medium which is carried by a user who is in a car of the elevator, a storage part which stores identification information and a destination floor in advance, the identification information being associated with the destination floor;

a temporary registration part which obtains the destination floor associated with the identification information read by the first reading part, from the storage part, and temporarily registers a call to the obtained destination floor; and a determination part which determines whether or not a predetermined destination floor establishment condition is established based on at least a reading status of the identification information by the first reading part and an input status of a destination floor to the hall operating panel, wherein when it is determined that the predetermined destination floor establishment condition is established by the determination part, temporary registration by the temporary registration part is established and set as regular registration, and wherein the predetermined destination floor establishment condition is that same identification information as the identification information which is read by the first reading part is read by the second reading part, before a predetermined establishment determination time period elapses without a destination floor being inputted to the hall operating panel, after the identification information is read by the first reading part.

2. The elevator-landing device according to claim 1, further comprising:

a detection part which detects a number of users who are in the car, wherein when the number of users detected by the detection part does not correspond to a number of kinds of identification information read by the second reading part, departure of the car is inhibited.

* * * * *